US008348362B2

(12) United States Patent
Candeo et al.

(10) Patent No.: US 8,348,362 B2
(45) Date of Patent: Jan. 8, 2013

(54) PIVOTING LID FOR REFRIGERATOR DOOR

(75) Inventors: Marcelo Candeo, Anderson, SC (US); Shawn Michael Clark, Easley, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 338 days.

(21) Appl. No.: 12/712,338

(22) Filed: Feb. 25, 2010

(65) Prior Publication Data

US 2010/0219731 A1 Sep. 2, 2010

Related U.S. Application Data

(60) Provisional application No. 61/155,954, filed on Feb. 27, 2009.

(51) Int. Cl.
*A47B 96/04* (2006.01)

(52) U.S. Cl. ..... 312/404

(58) Field of Classification Search ..... 312/404, 312/405, 405.1, 408, 321.5; 62/337, 440, 62/449

See application file for complete search history.

(56) References Cited

U.S. PATENT DOCUMENTS

| | | | | |
|---|---|---|---|---|
| 463,150 | A | 11/1891 | Graves | |
| 2,132,737 | A * | 10/1938 | Kahn | 126/340 |
| 4,732,435 | A | 3/1988 | Bailey et al. | |
| 5,193,892 | A * | 3/1993 | Swindell | 312/405.1 |
| 5,409,308 | A | 4/1995 | Reuter et al. | |
| 5,765,390 | A | 6/1998 | Johnson et al. | |
| 5,947,573 | A | 9/1999 | Tovar et al. | |
| 6,074,030 | A | 6/2000 | Prunty et al. | |
| 6,227,635 | B1 | 5/2001 | Teppo et al. | |
| 6,471,312 | B1 | 10/2002 | Coffey et al. | |
| 6,834,922 | B2 | 12/2004 | Cho | |
| 2004/0217680 | A1 | 11/2004 | Lee | |
| 2005/0073226 | A1 | 4/2005 | Antos et al. | |
| 2005/0172657 | A1 | 8/2005 | Hwang | |
| 2006/0061247 | A1 * | 3/2006 | Lee et al. | 312/404 |
| 2006/0192469 | A1 | 8/2006 | Koo | |
| 2008/0203876 | A1 * | 8/2008 | Lim et al. | 312/405 |
| 2008/0271475 | A1 * | 11/2008 | Wuesthoff et al. | 62/447 |

FOREIGN PATENT DOCUMENTS

| | | |
|---|---|---|
| EP | 0721093 | 7/1996 |
| WO | 03036202 | 5/2003 |
| WO | 2004038312 | 5/2004 |

OTHER PUBLICATIONS

International Search Report for PCT/US2010/025355, dated Dec. 1, 2010, 2 pages.

* cited by examiner

*Primary Examiner* — Hanh V Tran
(74) *Attorney, Agent, or Firm* — Pearne & Gordon LLP

(57) ABSTRACT

A storage assembly includes a first storage compartment mounted within an interior chamber, a cover, and a slot. The first storage compartment is configured to move in a first direction between a first and a second position. The cover is secured to the first storage compartment and configured to pivot about an axis between a closed and an open position. The slot is located on one of a sidewall within the interior chamber or the cover, where the other one of the sidewall or the cover is configured to engage the slot. The cover moves in a second direction corresponding to a shape of the slot as the first storage compartment is moved between the first position and the second position. A second storage compartment can be provided above the first. The second storage compartment can move in the first direction despite the cover being in an open position.

22 Claims, 6 Drawing Sheets

PIVOTING LID FOR REFRIGERATOR DOOR

This application claims the benefit of U.S. Provisional Patent Application No. 61/155,954 filed on Feb. 27, 2009, the entire disclosure of which is hereby incorporated herein by reference.

FIELD OF THE INVENTION

The present invention relates to a storage assembly, and more particularly, to a storage assembly that includes a storage compartment in which a cover for the storage compartment is automatically opened when the storage compartment is moved outwards from the storage assembly.

BACKGROUND OF THE INVENTION

A refrigerator is an electrical appliance in which a refrigerating cycle of compression, condensation, expansion, and evaporation is repeated using refrigerant to store food at a low temperature. Generally, refrigerators are adapted to store various foods at a low temperature, in a fresh state, in freezing and refrigerating compartments defined in a refrigerator body, by circulating cold air in the freezing and refrigerating compartments. In the freezing compartment, food such as meat or ice cream, to be maintained at a temperature not higher than a freezing temperature thereof, is stored. On the other hand, food such as vegetables or beverages, to be maintained at a temperature slightly higher than the freezing temperature thereof, is stored in the refrigerating compartment or within temperature controlled storage containers within the refrigeration compartment. Thus, the recent tendency to equip refrigerators with storage containers has led to an increase in overall size of the refrigerator.

As large refrigerators are becoming more common, various types of refrigerators have been developed to satisfy the ever-increasing demands of the user. For example, a top refrigerator type is known in which a fresh food compartment is located above a freezing compartment and a side-by-side type refrigerator is known in which a freezing compartment and a fresh food compartment are positioned left and right of one another. A bottom refrigerator type is also known in which a fresh food compartment is located below a freezing compartment.

The bottom mount refrigerator concept is gaining in popularity because it provides easier access to the fresh food compartment in comparison with current side-by-side and top-mount refrigerators. The bottom mount refrigerator also has a better ergonomic position to store food and does not have as many hidden compartments.

Current bottom mount refrigerators have full-width storage compartments, which are popular with consumers. Within the fresh food compartment of the bottom mount refrigerator, it is known to have a pair or series of stacked compartments, resembling pull-out drawers, where the lid of the lower compartment automatically opens as the lower drawer is pulled out. In this situation, the lid of the lower drawer can block simultaneous access to the upper drawer.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In one example aspect, a storage assembly comprises a storage assembly body, an interior chamber located within the storage assembly body, a first storage compartment mounted within the interior chamber, a cover, and a slot. The first storage compartment is configured to move in a first direction between a first position and a second position. The cover is secured to the first storage compartment and configured to pivot about an axis between a closed position and an open position. The closed position of the cover restricts access to the first storage compartment when the first storage compartment is in the first position. The open position of the cover allows access to the first storage compartment when the first storage compartment is in the second position. The slot is located on one of a sidewall within the interior chamber or the cover, where the other one of the sidewall or the cover is configured to engage the slot for pivoting about the axis. The cover moves in a second direction corresponding to a shape of the slot as the first storage compartment is moved between the first position and the second position.

In another example aspect, a storage assembly comprises a storage assembly body, an interior chamber located within the storage assembly body, a first storage compartment mounted within the interior chamber, a cover, a slot, and a second storage compartment mounted within the interior chamber above the first storage compartment. The first storage compartment is configured to move in a first direction between a first position and a second position. The cover is secured to the first storage compartment and configured to pivot about an axis between a closed position and an open position. The closed position of the cover restricts access to the first storage compartment when the first storage compartment is in the first position. The open position of the cover allows access to the first storage compartment when the first storage compartment is in the second position. The slot is located on one of a sidewall within the interior chamber or the cover, where the other one of the sidewall or the cover is configured to engage the slot for pivoting about the axis. The cover moves in a second direction corresponding to a shape of the slot as the first storage compartment is moved between the first position and the second position. The second storage compartment is located above the first storage compartment, where the second storage compartment is configured to be moved in the first direction when the cover of the first storage compartment is in either the open position or the closed position.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
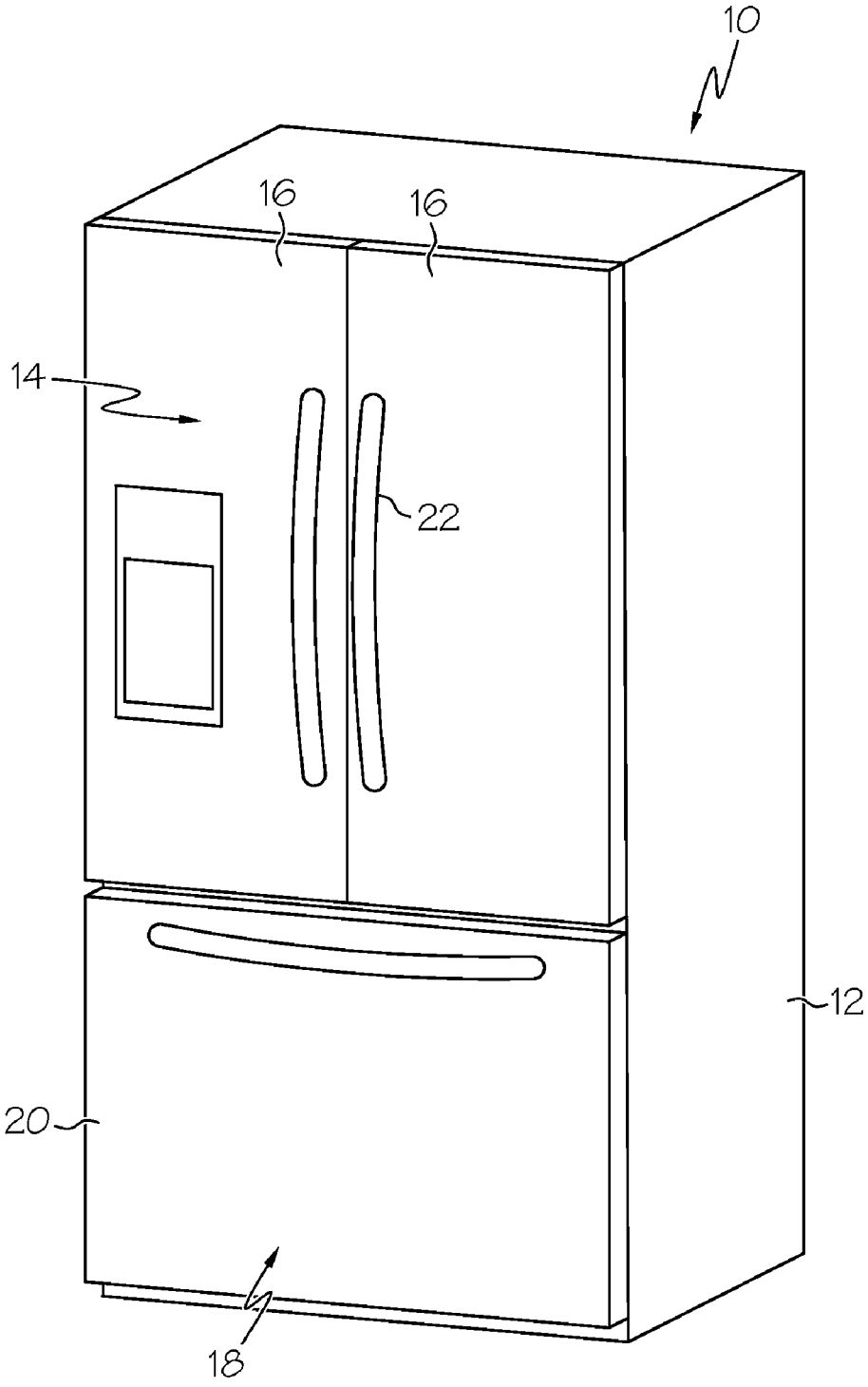
FIG. 1 illustrates a perspective view of a refrigerator.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, there is shown a storage assembly 10. The storage assembly 10 can include any type of appliance or other assembly that is configured for the storage of a variety of objects. In this illustration, the storage assembly 10 includes a storage assembly body 12, such as a refrigerator, that includes a freezer compartment 14 located in the upper portion of the interior chamber of the storage assembly body 12. The freezer compartment 14 may be accessed through an upper mounted hinged freezer door 16. The freezer compartment 14 is used to freeze and/or maintain food articles stored within a frozen condition. The freezer compartment 14 may be maintained at a temperature at or below zero degrees Centigrade. In FIG. 1, the lower portion of the refrigerator includes a fresh food compartment 18. The fresh food compartment 18 may be accessed through a single hinged door 20 or double doors, also known as French doors. The fresh food compartment 18 is used to keep food articles fresh and maintain them at a temperature near and above zero degrees Centigrade. On the external side of the doors 16 and 20, a handle 22 is attached to each door 16 and 20, to allow the user to easily open and close the doors 16 and 20.

Figure 2:
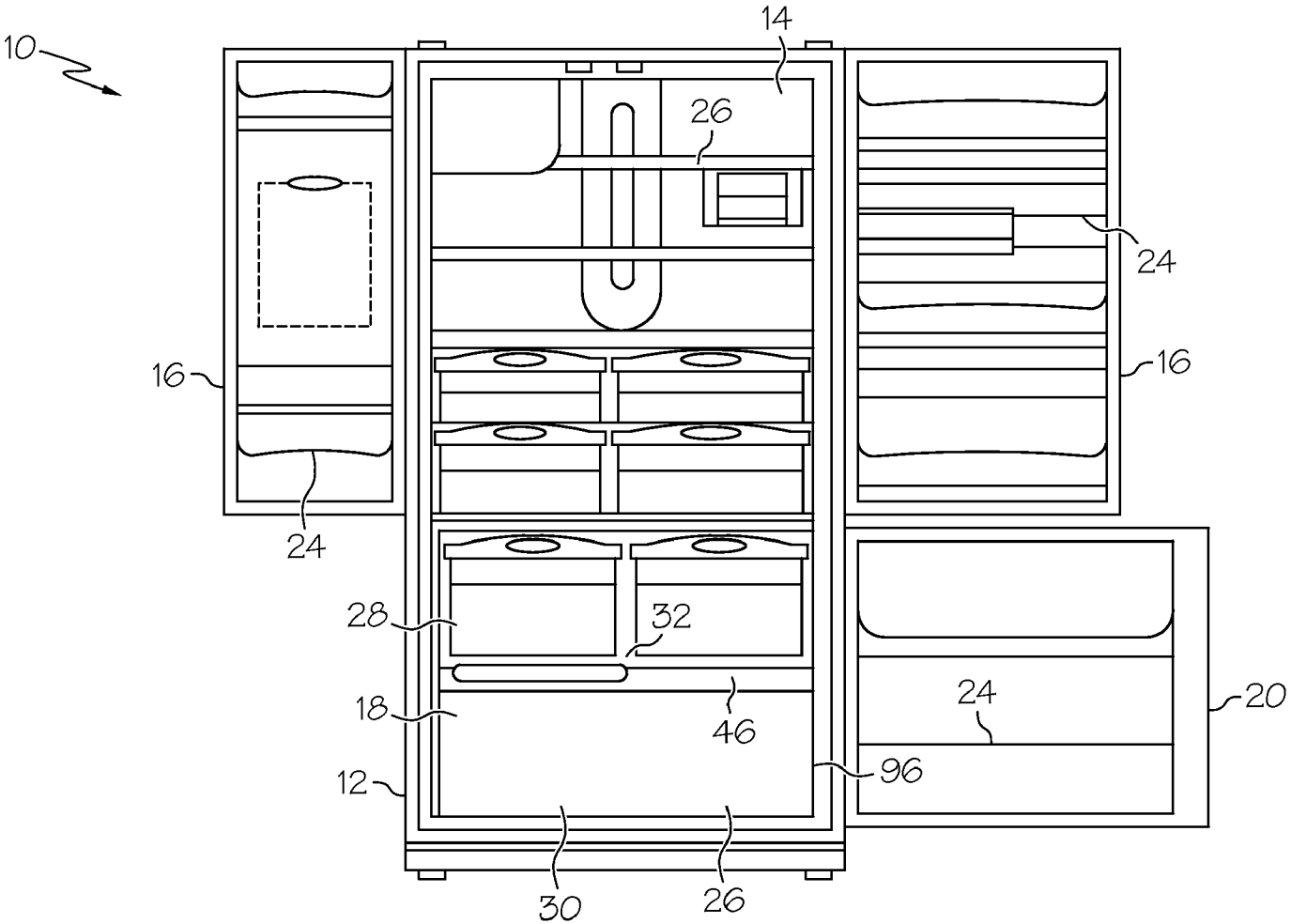
FIG. 2 illustrates a front/perspective view of the refrigerator with the doors open showing the storage compartments.

With reference to FIG. 2, the refrigerator doors 16 and 20 are open showing the fresh food and frozen food compartments 18 and 14, respectively. Internally, both doors 16 and 20 are provided with a plurality of shelves 24 adapted to store beverages or food. Additionally, the shelving integrated into the doors 16 and 20 are a substantial reverse complement to their respective compartments 14 and 18. This permits an effective method to maximize the internal space of the storage assembly 10.

Accordingly, within both the fresh food and frozen food compartments 18 and 14 may be an assembly of storage drawers or storage compartments 26. When the doors 16 and 20 are in a closed position, as shown in FIG. 1, the storage compartments 26 are also in a stored position. As shown in FIG. 2, within the fresh food compartment 18, there may be an upper storage compartment 28 and a lower storage compartment 30. However, the illustration should be viewed as exemplary and the embodiment should not be limited to only an upper and lower compartment. The example in FIG. 1 should be understood as being applicable to any storage assembly compartment having many different storage compartment arrangements.

Additionally, the upper and lower storage compartments 28 and 30 described below and are capable of being integrally formed with their corresponding fresh food or frozen food compartments 18, 14. However, the storage compartments 28 and 30 shown below may be separate from, and suitably attached to, their corresponding fresh food or frozen food compartments 18, 14.

Both upper and lower storage compartments 28 and 30 can include compartment housings 32. The compartment housings 32 may be used to support and stabilize the storage compartments 28 and 30 within the storage assembly body 12 as a user accesses the storage compartments 28, 30. In one embodiment, the compartment housings 32 may be protective casings anchored to the internal sidewalls 96 of the refrigerator body 12 that surround the storage compartments 28 and 30. In another embodiment, the compartment housings 32 may resemble a rail system mounted on the internal sidewalls of the refrigerator body 12 where the storage compartments 28, 30 may be movably attached within the rails, allowing for movement, such as a horizontal movement, of the storage compartments 28, 30.

Figure 3:
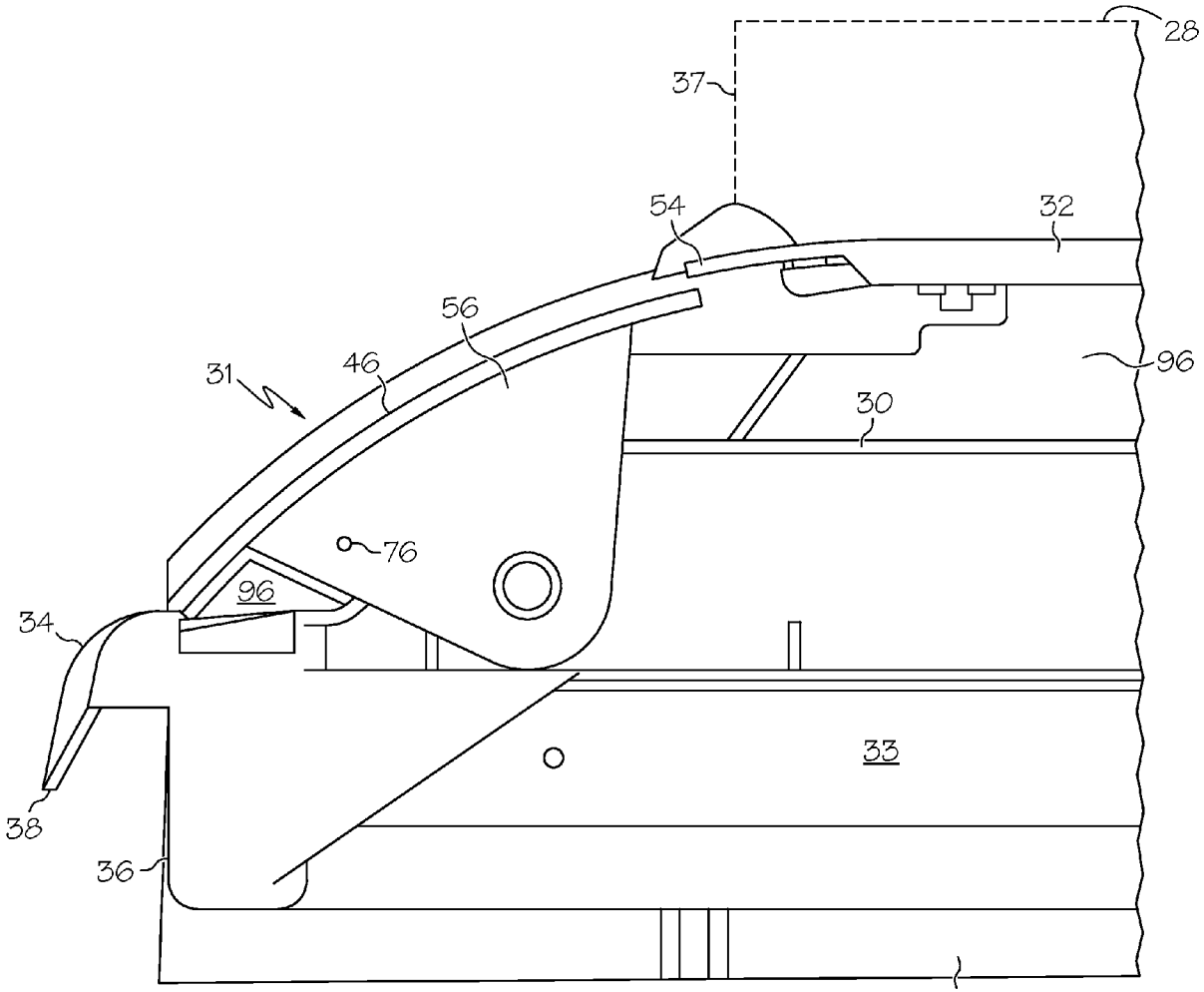
FIG. 3 illustrates a cross-sectional side view of the lower storage compartment with the cover in a closed position.

With reference to FIGS. 2 and 3, in one embodiment, the upper and lower storage compartments 28, 30 can be configured as pull-out drawers. Additionally, a pulling mechanism 34 may be integrated into the front face 36 of the storage compartments 28, 30. The pulling mechanism 34 may be a handle 38, as shown in FIG. 3. Alternatively, instead of a handle 38, the pulling mechanism 34 can include a semi-circular recess on the front face 36 enabling a user to pull the storage compartments 28, 30. As a result, both the upper compartment storage 28 and the lower storage compartment 30 are moveable in a first direction 40 and a second direction 42. The first direction 40 can be associated with a pulling motion away from the refrigerator body 12, and the second direction 42 can be associated with a pushing motion toward the refrigerator body 12. In further examples, other directions of movement can be provided, such as upwards, downwards, left, right, or any other angular or curved direction relative to the storage assembly body 12. A rail 33 that is part of a rail system can be provided for allowing the storage compartment 30 to be moved. The rail 33 can be located on both sides of either storage compartment 28, 30.

Figure 4:
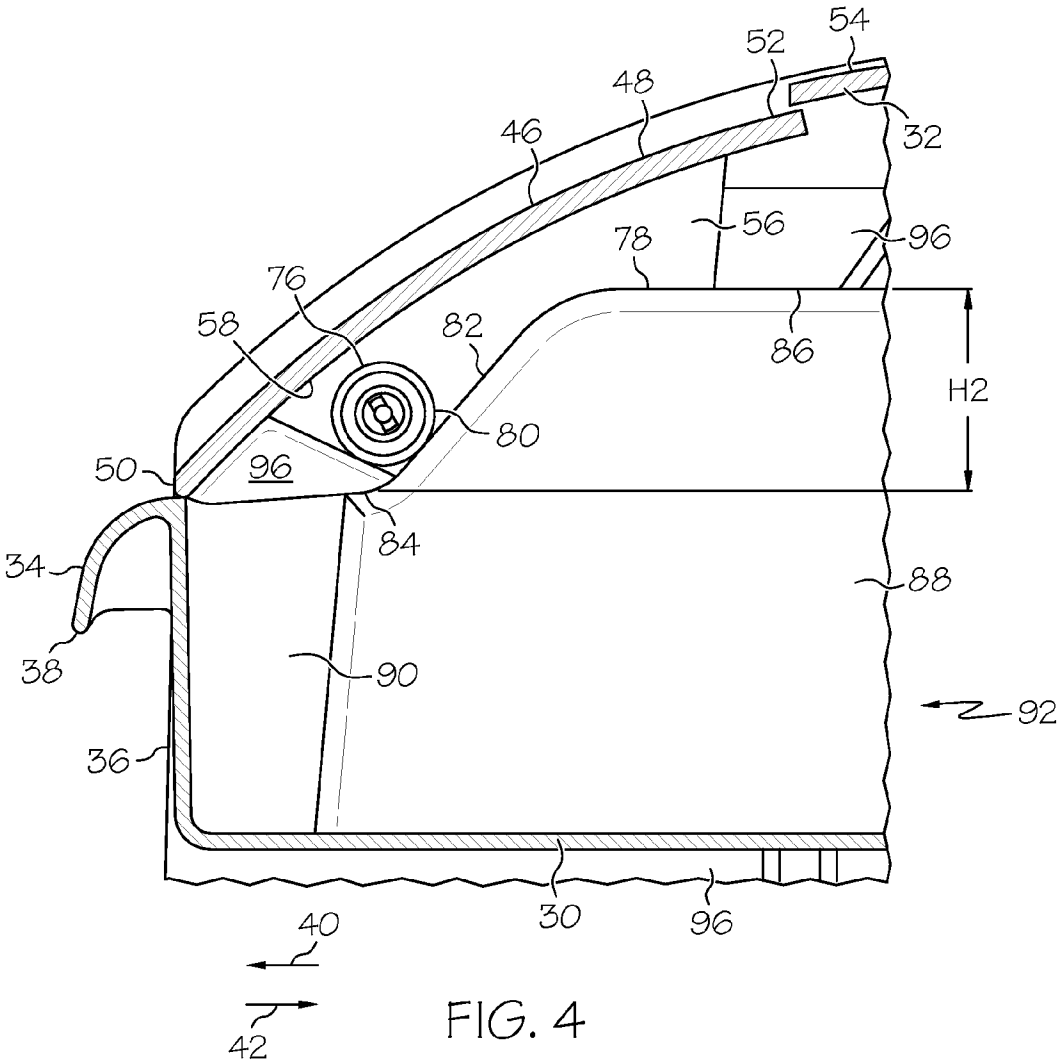
FIG. 4. illustrates the storage compartment from the opposing cross-sectional side as shown in FIG. 3, illustrating the bearing of the cover and an inclined surface portion of the storage compartment.
Figure 5:
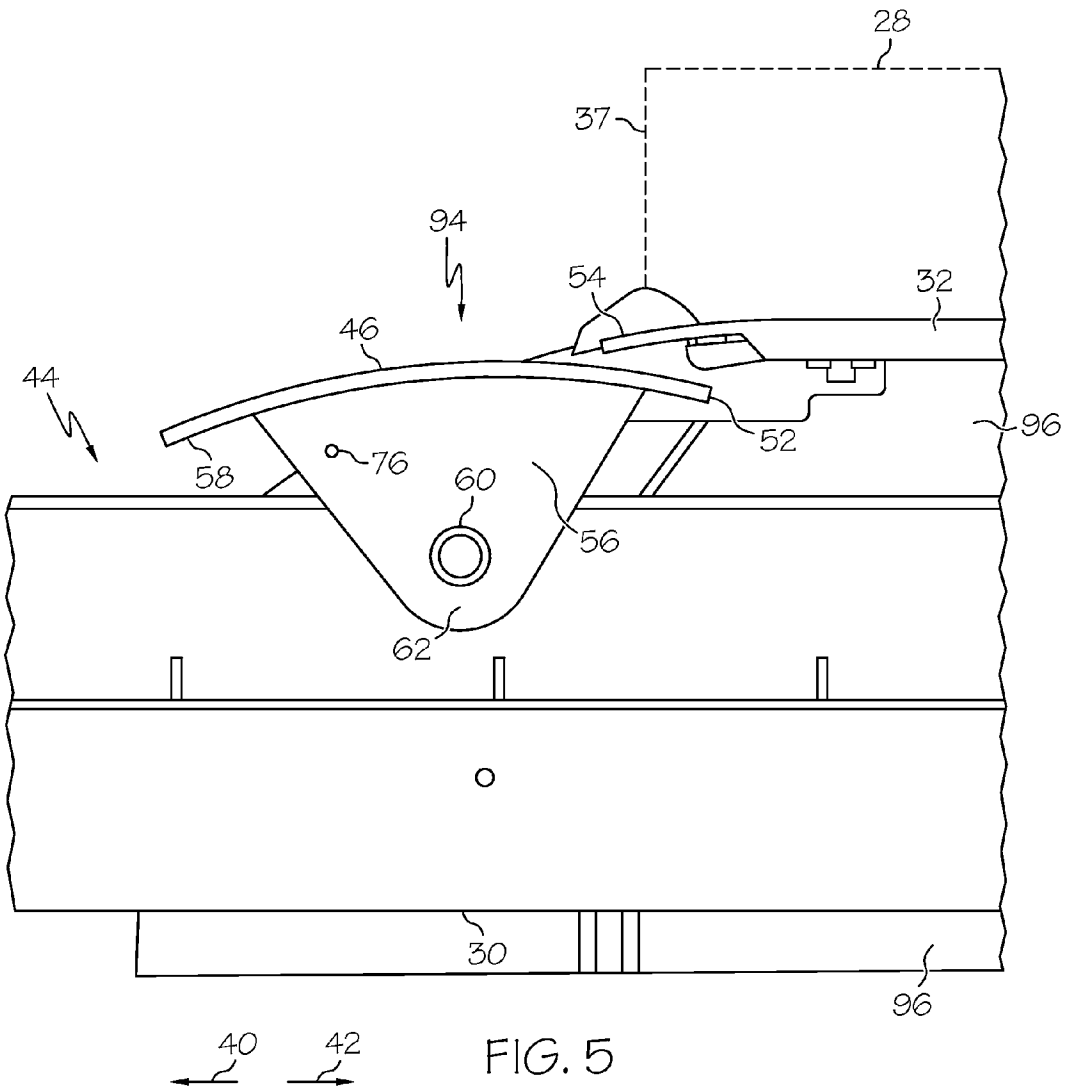
FIG. 5 illustrates a cross-sectional side view of the lower storage compartment with the cover in an open position.

With reference to FIGS. 2-5, the upper storage compartment 28 can form a fully enclosed, box-like compartment. The lower storage compartment 30 can have a box-like shape (i.e., a base floor with 4 perpendicular walls). Other shapes for the upper storage compartment 28 and the lower storage compartment 30 can also be provided. In some examples, the front face 36 of the lower storage compartment 30 is flush with the front face 37 of the upper storage compartment 28. In the example of FIG. 5, the front face 36 of the lower storage compartment 30 can project in a forward direction beyond the front face 37 of the upper storage compartment 28 creating an access space 44. The access space 44 allows a user access to the internal area within the storage compartments 28, 30. Accordingly, when the storage compartment 30 is fully extended in the first direction 40, the available access space 44 may be increased so that larger items may be inserted into and stored within the storage compartments 28, 30. In the example of FIG. 5, the access space 44 is accessible from the top portion of the storage compartment 30. In other examples, the access space 44 can be accessible from different directions relative to the storage compartment 30, such as from a front direction.

With reference to FIGS. 3 and 4, when the lower storage compartment 30 is in a first position such as a stored position, a cover 46 secured to the lower storage compartment 30 is in a closed position 31. The cover 46 restricts access to the storage compartment 30 when the storage compartment is in the first position, such as the stored position. In one example, the cover 46 may be made of a transparent material to enable a user to view the contents of the lower storage compartment 30 without opening the lower storage compartment 30. In another example, the cover 46 may have an arcuate shape 48. The cover 46 can also have a variety of other shapes, including a relatively straight shape.

With reference to FIGS. 3-5, the cover 46 can include a flange 56 located on a backside 58 of the cover 46. The flange 56 can be located on each opposing end of the backside 58 of the cover 46. The flange 56 on one end of the cover 46 mirrors the flange 56 at the opposing end of the cover 46. An appendage 64 can be provided that protrudes from the flange 56. A slot 70 can be located on one of a sidewall within the interior chamber or the cover 46. The other one of the sidewall or the cover 46 is configured to engage the slot 70 for pivoting about the axis X.

In a first example, the slot 70 is on a sidewall within the interior chamber. The sidewall within the interior chamber can be the sidewall 96 of the interior chamber. Alternatively, the slot 70 can be located on any other sidewall within the interior chamber, such as a sidewall (not shown) of the compartment housing 32. The cover 46 is configured to engage the slot 70 for pivoting about the axis X.

Figure 6:
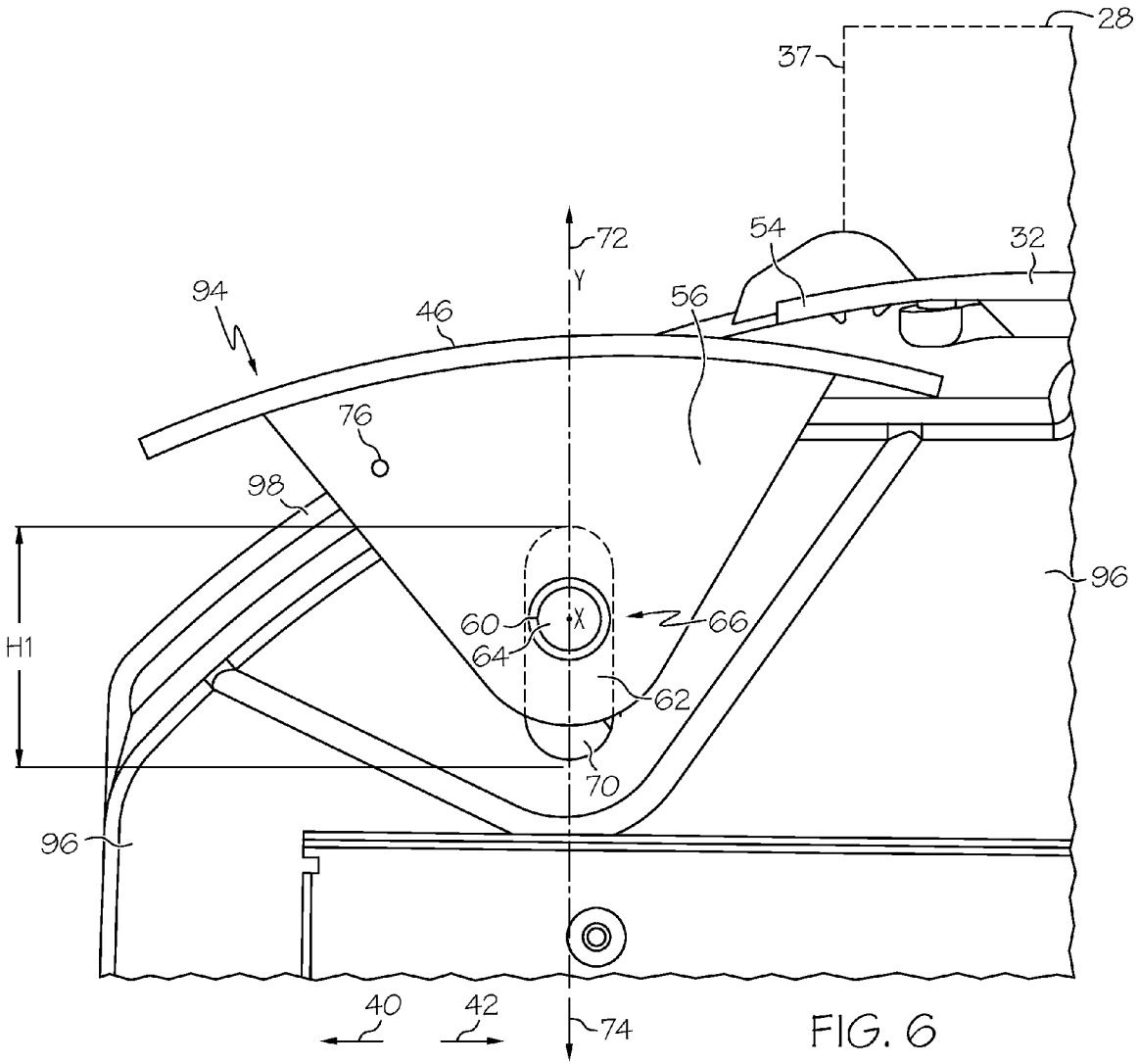
FIG. 6 illustrates a detailed cross-sectional side view of the storage compartment with the cover in the open position and the interaction of the cover with a slot.

In the first example, the cover 46 is configured to pivot about the axis X between a closed position 31 (shown in FIG. 3) and an open position (shown in FIGS. 5 and 6). The closed position 31 of the cover 46 restricts access to the first storage compartment 30 when the first storage compartment 30 is in the first position (e.g. the stored position). The open position of the cover 46 allows access to the first storage compartment 30 when the first storage compartment 30 is in the second position (e.g. the accessible position). The cover 46 can move between the closed position and the open position automatically as the storage compartment 30 is moved, such as outwardly from the storage assembly.

With reference to FIGS. 4 and 6, the appendage 64 can also be moveable in another direction, such as a third direction. The appendage 64 and the cover 46 can move back and forth along the third direction corresponding to the shape of the slot 70 as the first storage compartment 30 is moved between a first position and a second position, such as the stored position and an accessible position. The accessible position refers to when the storage compartment 30 is moved outwardly from the storage assembly, such as in FIG. 5. The third direction corresponding to the path of the slot 70 can be upwards, downwards, left, right, or any other angular or curved direction relative to the storage assembly body 12. The third direction can be different than the first and second direction. When the cover 46 is mated to a sidewall within the interior chamber such as either a sidewall of the compartment housing 32, the sidewalls 96 of the interior chamber, or to the storage compartment 28, 30 itself, the cover 46 can be moveable in this example in the third direction, such as an upwards direction 72 and a downwards direction 74 along a vertical slot 70 about a substantially vertical axis Y. Additionally, the slot 70 can have a height H1. Thus, in addition to the cover 46 being rotatable about a radial axis X, the cover 46 can have an amount of height adjustment via the vertical slot 70. The amount of height adjustment via the vertical slot 70 enlarges an access space 44 for the storage compartment 30.

In further examples, the cover 46 can be configured to pivot about the axis X during a first portion of the movement of the storage compartment 30 between the first position and the second position where the cover 46 moves in the third direction corresponding to the shape of the slot 70 during only a second portion of the movement of the storage compartment 30 between the first position and the second position. In still further examples, the cover 46 can be configured to pivot about the axis X while also moving in the third direction corresponding to the shape of the slot 70.

In a second example, a mounting recess 60 can be further provided along with the flange 56 on the backside of the cover 46, the slot 70 on the sidewall 96, and the appendage 64 protruding from the flange 56, as already described. The recess 60, as shown in FIG. 6, can be located on the sidewall 96 and is configured to mate with the appendage 64 to provide movement of the cover 46 corresponding to the shape of the slot 70. The recess 60 that carries the appendage 64 is moveable within the substantially vertical slot 70. The mechanical fastening of the recess 60 with the appendage can form a hinge 66. Once mated, the flange 56 and the hinge 66 also allow the cover 46 to exert a rotating motion about a radial axis X in addition to the motion corresponding to the shape of the slot 70. In another embodiment, the appendage 64 may be located on the flange 56 and the recess 60 may be located on the compartment housing 32.

In a third example, the sidewall within the interior chamber can include the protruding appendage 64 and the slot 70 can be located on the cover 46, such as on the flange 56. The sidewall within the interior chamber can refer to the sidewalls 96 of the interior chamber or a sidewall of the compartment housing 32. It is important to note that a male/female mechanical connection to allow a rotation and vertical movement should not be limiting. The apparatus is capable of incorporating any type of mechanical connection. For example, a pin may be used in the interior chamber or in the compartment housing 32 and may be adapted to mate with a recess in the flange 56.

In a fourth example, the mounting recess 60 is further provided along with the slot 70 on the flange 56 of the cover 46 and the appendage 64 protruding from the sidewall within the interior chamber. Each flange 56 further includes the mounting recess 60 at the distal end 62 of the flange 56 with respect to the cover 46. The mounting recess 60 is configured to mate with the appendage 64 from the sidewall within the interior chamber for movement of the storage compartment 30 corresponding to the shape of the slot 70.

With reference to FIG. 4, each flange 56 can have a drive device 76 in any of the examples described. The drive device 76 can be movably fixed to the base of the flange 56 and in close proximity to the backside 58 of the cover 46. In one example, the drive device 76 can be adapted to rest on a surface 78 of the storage compartment 30. In a further example, the drive device 76 can be mechanically attached bearing 80 to the flange 56 that rests on the upper edge of the surface 78. The surface 78 of the storage compartment 30 can correspond to an outer wall of the storage compartment 30.

With further reference to FIG. 4, the surface 78 can have an inclined surface portion 82. The surface 78 can also run along the length of the storage compartment 30. The surface 78 can also have an inclined surface portion 82 having a height H2. The drive device 76 is configured to move along the incline of the inclined surface portion 82 as the first storage compartment 30 is moved from the first position to the second position. A base portion 50 of the cover 46 may be resting on the storage compartment 30 while the drive device 76 may be resting on the surface 78 at the base of the inclined surface portion 82. Alternatively, the base portion 50 of the cover 46 may rest on the pulling mechanism 34 of the lower storage compartment 30.

The inclined surface portion 82 may have its lowest height 84 near the front of the storage compartment 30 and a highest height 86 that is closer to the rear 88 of the storage compartment 30. Thus, the inclined surface portion 82 increases in height from the front 90 to the rear 88 of the storage compartment 30. The inclined surface portion 82 can have a variety of shapes with various segments and different shaped portions corresponding to different paths for the drive device 76.

In another example, the drive device 76 can be fixed to the flange 56 and configured to move within a track or groove 98 along a sidewall within the interior chamber, such as the sidewall 96 of the interior chamber or the sidewall of the storage compartment housing. The drive device 76 can be configured to move along the groove 98 as the storage compartment is moved between the first position and the second position. A schematic of the groove 98 is shown in FIG. 6.

With reference to FIG. 6, the inclined surface portion 82 of the surface 78 is related to the substantially vertical slot 70 of the compartment housing 32. As the drive device 76 moves up the inclined surface portion 82 as a user moves the storage compartment 30 from the first position to the second position, the hinge 66 moves a vertical distance within the vertical slot 70 that is substantially equal to the height of the incline H2. In one embodiment, the vertical slot 70 height is about two times the side wall incline height H2. Preferably, the vertical slot height H1 is about one-and-a-half times the incline height H2.

Any of the components shown in FIGS. 2-6 can be used with either the upper storage compartment 28 or the lower storage compartment 30. Accordingly, a cover can be placed on one of or both of the first storage compartment 30 and the second storage compartment 28. As the pivoting lid assembly has been described, the motion of the assembly and interaction of the elements is hereby described.

With further reference to FIG. 4, when a user desires access to the contents of the lower storage compartment 30, the storage compartment 30 is pulled in a first direction 40 away from the stored position 92. As the storage compartment 30 is moved in the first direction 40, the drive device 76 may begin to climb the inclined surface portion 82 on the surface 78 of the storage compartment 30. This begins to pivot the cover 46 as the hinge 66 (combination of recess 60 and appendage 64) allows for rotation about the radial axis X. Simultaneously, hinge 66 may be raised upwards within the vertical slot 70 at a rate that matches the vertical movement of the drive device 76 up the inclined surface portion 82. Once the drive device 76 reaches the highest height 86 at the top of the surface 78, the cover 46 has pivoted into a rocked back position 94, as shown in FIG. 5. The rocked back position 94 refers to a position where the cover 46 has completed its movement along the path of the slot 70. Additionally, when the storage compartment 30 is pulled outwards to the second position, a top portion 52 of the cover 46 can be slightly offset with respect to a compartment housing ceiling 54 to enable movement of the cover 46 to the open position while avoiding obstructing access to the upper storage compartment 28. In this example, the cover 46 moves underneath a portion of the compartment housing 32. The storage compartment 30 may be then fully extended in the first direction 40 without any impedance from the cover 46. The user can then have improved access to the access space 44 and the contents of the storage compartment 30, as the cover 46 is moved along the slot 70. The improved access is provided by the movement of the slot 70 to provide an increased space to the interior of the storage compartment 30.

When the lower storage compartment 30 is in the fully extended position, it may be possible for the user to gain access to the upper storage compartment 28 simultaneously, even with the upper storage compartment 28 mounted directly above the lower storage compartment 30 and the cover 46 pivoted upwardly and in an open position. The user merely needs to pull the lower storage compartment 30 in the first direction 40 to an open position without regard to the upper storage compartment 28 position. Thus, the cover 46 can be configured to be in a position that provides full access to the access space 44 and the contents of the lower storage compartment 30 while also not interfering with the movement of the upper storage compartment 28. Thus, the improved access does not restrict or prevent a user from also opening the upper storage compartment 28 located above the storage compartment 30 when the storage compartment is moved to the accessible position. In further examples, the second storage compartment 28 can move in different directions than the first storage compartment 30.

As shown in FIG. 6, the lower storage compartment 30 is in the accessible position, as it is fully extended. Thus, the cover 46 is in the rocked back position 94, the storage compartment 30 is fully extended, the drive device 76 is resting on the highest height 86 of the surface 78, and the hinge 66 may be near the top of the vertical slot 70. If access to the storage compartment 30 is no longer desired, the user moves the storage compartment 30 in a second direction 42 back into the refrigerator body 12. Accordingly, as the drive device 76 travels down the inclined surface portion 82, the hinge 66 will move across the path of the slot 70, in this example in a downwards direction. Once the drive device 76 reaches the lowest height 84 of the inclined surface portion 82 and the hinge 66 reaches the lower portion of the vertical slot 70, the cover 46 has rotated back into the closed position 31, as shown in FIG. 4.

By optimizing the movement of the inclined surface portion 82 and the vertical slot 70, the cover 46 will not impede access to the upper storage compartment 28 during and after an opening motion of the lower compartment cover 46. The rotation of the cover 46 can be controlled in both the opening and closing motions via the hinge 66, vertical slot 70, drive device 76 and inclined surface portion 82 acting in unison. This automated movement of the cover 46 enhances the quality and convenience of the product.

Particular compartments and related apparatus have been described. However, the examples described may apply to any storage compartments or pull-out drawers within a refrigerator (not just the lower compartment). Additionally, the examples described are also applicable to other forms of appliances and storage assemblies or storage containers having storage compartments, such as stacked storage bins and the like. For example, a storage assembly can include a first storage compartment housing and a second storage compartment housing within a body of the storage assembly. A storage assembly can include similar structure and components as shown in each of FIGS. 2-6.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A storage assembly comprising:

a storage assembly body;

an interior chamber located within the storage assembly body;

a first storage compartment mounted within the interior chamber and configured to move in a first direction between a first position and a second position;

a cover secured to the first storage compartment and configured to pivot about an axis between a closed position and an open position, wherein the closed position of the cover restricts access to the first storage compartment when the first storage compartment is in the first position and wherein the open position of the cover allows access to the first storage compartment when the first storage compartment is in the second position; and a slot located on one of a sidewall within the interior chamber or the cover, wherein the other one of the sidewall or the cover is configured to engage the slot for pivoting about the axis, and wherein the cover moves in a second direction corresponding to a shape of the slot as the first storage compartment is moved between the first position and the second position.

2. The storage assembly of claim 1, wherein the first storage compartment includes a pulling mechanism.

3. The storage assembly of claim 2, wherein the pulling mechanism comprises a handle.

4. The storage assembly of claim 1, further comprising:

a flange located on a backside of the cover wherein the slot is located on the sidewall;

an appendage protruding from the flange, wherein the appendage of the cover is configured to engage the slot located on the sidewall for pivoting about the axis.

5. The storage assembly of claim 1, further comprising:

a flange located on a backside of the cover, wherein the slot is located on the sidewall;

an appendage protruding from the flange, wherein the appendage of the cover is configured to engage the slot located on the sidewall for pivoting about the axis and movement corresponding to the shape of the slot;

a groove located in the sidewall; and a drive device fixed to the flange wherein the drive device is movably mounted within the groove and the drive device is configured to move along the groove as the first storage compartment is moved from the first position to the second position.

6. The storage assembly of claim 5, wherein the drive device comprises a pin fixed to the flange.

7. The storage assembly of claim 1, further comprising:

a flange located on a backside of the cover, wherein the slot is located on the sidewall;

an appendage protruding from the flange, wherein the appendage of the cover is configured to engage the slot located on the sidewall for pivoting about the axis and movement corresponding to the shape of the slot;

a surface of the first storage compartment includes an inclined surface portion; and a drive device fixed to the flange wherein the drive device rests on an upper edge of the inclined surface portion and the drive device is configured to move along the inclined surface portion as the first storage compartment is moved from the first position to the second position.

8. The storage assembly of claim 7, wherein the drive device comprises a mechanically attached bearing.

9. The storage assembly of claim 1, wherein the cover has an arcuate shape.

10. The storage assembly of claim 1, wherein the cover has a top portion that is offset with respect to a housing ceiling when the cover is in the open position.

11. The storage assembly of claim 1, further comprising:

a flange located on a backside of the cover, wherein the slot is located on the flange;

an appendage protruding from the sidewall within the interior chamber, wherein the appendage of the sidewall is configured to engage the slot located on the flange for pivoting about the axis and movement corresponding to the shape of the slot.

12. The storage assembly of claim 1, further comprising:

a flange located on a backside of the cover, wherein the slot is located on the flange;

an appendage protruding from the sidewall within the interior chamber, wherein the appendage of the sidewall is configured to engage the slot located on the flange for pivoting about the axis and movement corresponding to the shape of the slot;

a groove located in the sidewall; and a drive device fixed to the flange wherein the drive device is movably mounted within the groove and the drive device is configured to move along the groove as the first storage compartment is moved from the first position to the second position.

13. The storage assembly of claim 1, further comprising:

a flange located on a backside of the cover, wherein the slot is located on the flange;

an appendage protruding from the sidewall within the interior chamber, wherein the appendage of the sidewall is configured to engage the slot located on the flange for pivoting about the axis and movement corresponding to the shape of the slot;

a surface of the first storage compartment includes an inclined surface portion; and a drive device fixed to the flange wherein the drive device rests on an upper edge of the inclined surface portion and the drive device is configured to move along the inclined surface portion as the first storage compartment is moved from the first position to the second position.

14. The storage assembly of claim 1, further comprising:

a flange located on a backside of the cover wherein the slot is located on the sidewall;

an appendage protruding from the flange, wherein the appendage of the cover is configured to engage the slot located on the sidewall for pivoting about the axis; and a recess on the sidewall configured to mate with the appendage for movement corresponding to the shape of the slot.

15. The storage assembly of claim 1, further comprising:

a flange located on a backside of the cover, wherein the slot is located on the flange;

an appendage protruding from the sidewall within the interior chamber, wherein the appendage of the sidewall is configured to engage the slot located on the flange for pivoting about the axis;

a recess on the flange configured to mate with the appendage for movement corresponding to the shape of the slot.

16. A storage assembly comprising:

a storage assembly body;

an interior chamber located within the storage assembly body;

a first storage compartment mounted within the interior chamber and configured to move in a first direction between a first position and a second position;

a cover secured to the first storage compartment and configured to pivot about an axis between a closed position and an open position, wherein the closed position of the cover restricts access to the first storage compartment when the first storage compartment is in the first position and wherein the open position of the cover allows access to the first storage compartment when the first storage compartment is in the second position;

a slot located on one of a sidewall within the interior chamber or the cover, wherein the other of the sidewall and the cover is configured to engage the slot for pivoting about the axis, and wherein the cover moves in a second direction corresponding to a shape of the slot as the first storage compartment is moved between the first position and the second position; and a second storage compartment mounted within the interior chamber, wherein the second storage compartment is located above the first storage compartment, wherein the second storage compartment is configured to be moved in the first direction when the cover of the first storage compartment is in either the open position or the closed position.

17. The storage assembly of claim 16, further comprising:

a flange located on a backside of the cover wherein the slot is located on the sidewall;

an appendage protruding from the flange, wherein the appendage of the cover is configured to engage the slot located on the sidewall for pivoting about the axis.

18. The storage assembly of claim 16, further comprising:

a flange located on a backside of the cover, wherein the slot is located on the flange;

an appendage protruding from the sidewall within the interior chamber, wherein the appendage of the sidewall is configured to engage the slot located on the flange for pivoting about the axis and movement corresponding to the shape of the slot.

19. The storage assembly of claim 16, further comprising:

a flange located on a backside of the cover, wherein the slot is located on the flange;

an appendage protruding from the sidewall within the interior chamber, wherein the appendage of the sidewall is configured to engage the slot located on the flange for pivoting about the axis; and a recess on the flange configured to mate with the appendage for movement corresponding to the shape of the slot.

20. The storage assembly of claim 16, further comprising:

a flange located on a backside of the cover wherein the slot is located on the sidewall;

an appendage protruding from the flange, wherein the appendage of the cover is configured to engage the slot located on the sidewall for pivoting about the axis; and a recess on the sidewall configured to mate with the appendage for movement corresponding to the shape of the slot.

21. The storage assembly of claim 1, further comprising:

a flange located on a backside of the cover, wherein the slot is located on the sidewall;

an appendage protruding from the flange, wherein the appendage of the cover is configured to engage and move along the slot.

22. The storage assembly of claim 1, further comprising:

a flange located on a backside of the cover, wherein the slot is located on the flange;

an appendage protruding from the sidewall within the interior chamber, wherein the appendage of the sidewall is configured to engage and move along the slot.

* * * * *